United States Patent [19]

Wissinger

[11] 4,074,123

[45] Feb. 14, 1978

[54] COMBINATION REFLECTOR AND LIGHT SHIELD

[76] Inventor: Lawrence H. Wissinger, 337 Montgomery Ave., Springfield, Ohio 45506

[21] Appl. No.: 698,866

[22] Filed: June 23, 1976

[51] Int. Cl.[2] ..... F21V 7/00

[52] U.S. Cl. ..... 362/319; 362/351; 362/343

[58] Field of Search ..... 240/11, 11.1, 83, 105, 240/110, 92, 38, 39, 40, 44.1, 46.03, 46.47, 46.59, 22

[56] References Cited

U.S. PATENT DOCUMENTS

| | | | |
|---|---|---|---|
| 85,921 | 1/1869 | Foster | 240/110 |
| 234,763 | 11/1880 | Forsyth | 240/105 |
| 295,717 | 3/1884 | Baker et al. | 240/46.03 X |
| 2,482,543 | 9/1949 | Jackson et al. | 240/105 X |
| 2,700,100 | 1/1955 | Wissinger | 240/110 X |

*Primary Examiner*—Fred L. Braun
*Assistant Examiner*—Peter S. Wong

[57] ABSTRACT

This combination device consists primarily of a semi-cylindrical and light reflecting member, which is in sliding engagement with a shield or shade member, both of which are secured in bracket means for attachment to a lantern, such as those used by campers and the like.

1 Claim, 4 Drawing Figures

COMBINATION REFLECTOR AND LIGHT SHIELD

This invention relates to lantern attachments, more particularly to a combination reflector and light shield.

It is, therefore, the principal object of this invention to provide a combination reflector and light shield, which will be adaptable for use by outdoorsmen on lanterns, so as to provide eye comfort and safety.

Another object of this invention is to provide a combination reflector and light shield, which will employ a light reflective member, which will direct light in any desired direction, when desired, and the device will have a translucent member, which will serve as eye protective means.

A further object of this invention is to provide a light device, of the type described, which will have bracket means for securing it to a lantern, and in which the translucent member will be in slideable engagement with the reflector member, the combination being secured to the bracket by a suitable locking fastener, so as to enable the user to raise and lower the two above described elements, whenever desired.

Other objects of the invention are to provide a combination reflector and light shield, which is simple in design, inexpensive to manufacture, rugged in construction, easy to use and efficient in operation.

These and other objects will be readily evident upon a study of the following specification, and the accompanying drawing, wherein.

Figure 1:
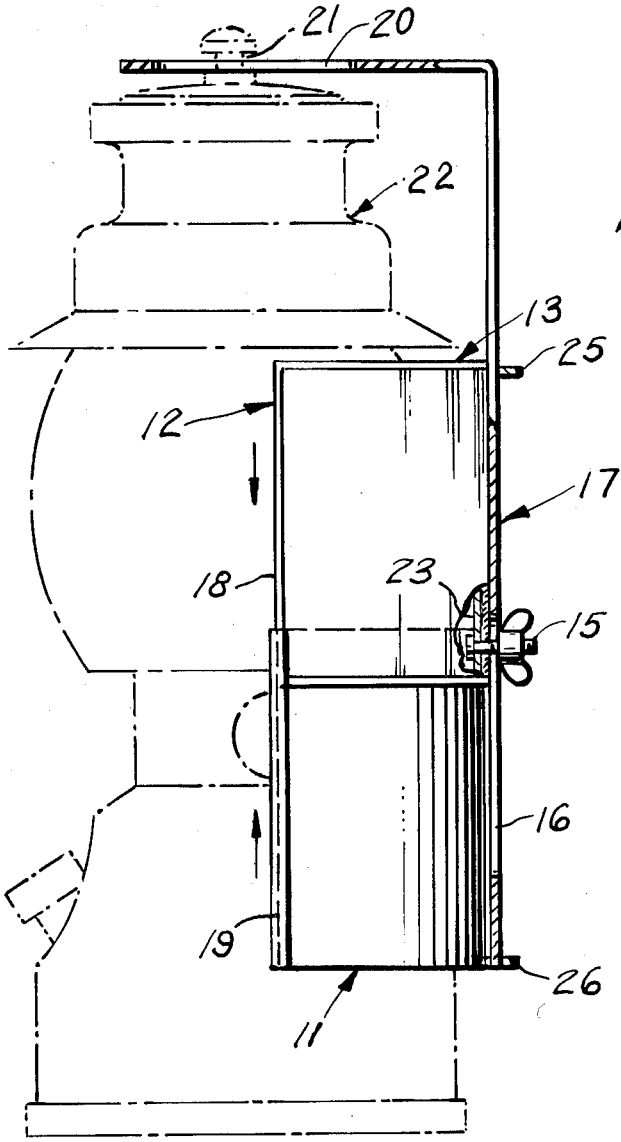
FIG. 1 is a side view of the present invention, shown partly broken away, and secured to a lantern, which is shown in phantom lines.
Figure 2:
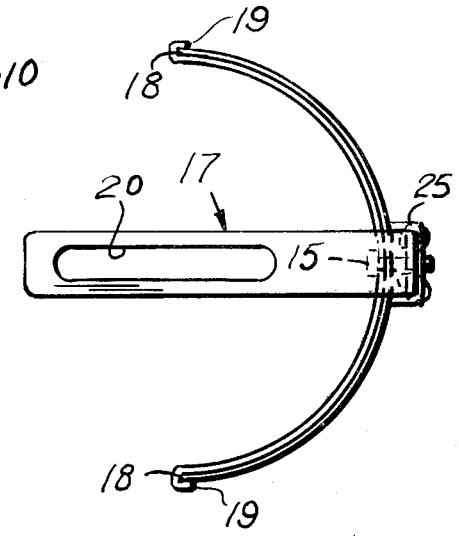
FIG. 2 is a top plan view of the invention, shown removed from the lantern.
Figure 3:
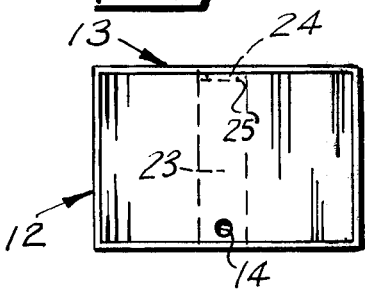
FIG. 3 is a rear view of the plastic shield or shade, shown in elevation and removed from the invention.
Figure 4:
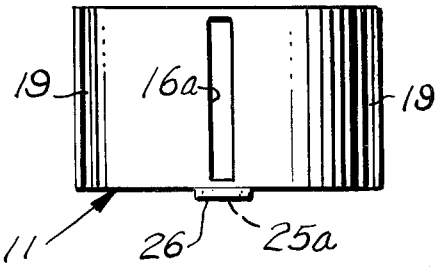
FIG. 4 is a rear view of the metal reflector, shown in elevation, and removed from the invention.

According to this invention, the combination reflector and light shield device 10 is shown to include an internally polished reflector shield 11, which is slideably secured within a translucent plastic shield or shade member 12, which is provided with an outer metal frame 13, so as to give it rigidity. An opening 14, through shield 12, freely receives a bolt fastener 15, which is freely slideable within an elongated opening 16 of the mounting bracket 17. A slot 16*a*, of shield 11, receives the bolt fastener 15, so as to alternately move shield 11 away from, and towards, shade member 12. The side edges 18 of shield 12 are slideably received within the channel edges 19 of the reflector shield 11. Mounting bracket 17 is of inverted, L-shaped configuration, and is provided with an elongated opening 20, in which the fastener 21, of lantern 22, is received. The fastener 21 serves as securement means for bracket 17, to lantern 22.

A metal strip 23 is fixedly secured, in a suitable manner, to the frame 13 of shield 12, and a slotted opening 24, within the lip 25, freely receives bracket 17, in conjunction with lip 26, secured fixedly to the reflector shield 11. The bracket 17 is freely received within the opening 25*a* of lip 26, and each of the lips 25 and 26 provides guide and alignment means for the light shield 12 and the reflector shield 11.

What I claim is:

1. A combination reflector and light shield for a lantern, comprising a threaded bolt fastener which receives a wing nut, said bolt fastener being removably received through the said reflector, the said light shield, and said light shield is translucent, so as to be alternately used with said reflector which is opaque, the said combination of said light shield and said reflector being semicylindrical in configuration and slidably engaging each other, and said reflector has an elongated slot which receives said bolt fastener, and said light shield has, secured fixedly thereto, a metal plate on its concave portion, which receives said bolt fastener and a lip with an opening, is fixedly secured on a peripheral edge of both said light shield and said reflector for receiving a bracket for a lantern.

* * * * *